US009786226B2

(12) United States Patent
Lee et al.

(10) Patent No.: US 9,786,226 B2
(45) Date of Patent: Oct. 10, 2017

(54) DISPLAY PANEL MODULE, ORGANIC LIGHT-EMITTING DIODE (OLED) DISPLAY AND METHOD OF DRIVING THE SAME

(71) Applicant: Samsung Display Co., Ltd., Yongin, Gyeonggi-do (KR)

(72) Inventors: Jae-Hoon Lee, Seoul (KR); Do-Hyung Ryu, Yongin-si (KR); Jae-Woo Song, Anyang-si (KR); Hae-Goo Jung, Seongnam-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 106 days.

(21) Appl. No.: 14/574,056

(22) Filed: Dec. 17, 2014

(65) Prior Publication Data

US 2015/0356925 A1 Dec. 10, 2015

(30) Foreign Application Priority Data

Jun. 5, 2014 (KR) ..... 10-2014-0068473

(51) Int. Cl.
*G09G 3/32* (2016.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2310/0205* (2013.01); (Continued)

(58) Field of Classification Search
USPC ..... 345/76, 212
See application file for complete search history.

(56) References Cited

U.S. PATENT DOCUMENTS 5,392,058 A * 2/1995 Tagawa ..... B25J 19/0012 345/103
6,249,326 B1 * 6/2001 Hebiguchi ..... G02F 1/136213 349/139

(Continued)

FOREIGN PATENT DOCUMENTS

KR 10-2005-0006602 A 1/2005
KR 10-2006-0057166 A 5/2006

(Continued)

*Primary Examiner* — Carolyn R Edwards
*Assistant Examiner* — Deeprose Subedi
(74) *Attorney, Agent, or Firm* — Knobbe Martens Olson & Bear, LLP.

(57) ABSTRACT

A display panel module, organic light-emitting diode (OLED) display and method of driving the same are disclosed. In one aspect, the module includes a display panel divided into a first portion and a second portion and a plurality of scan and data lines divided into groups arranged in the first and second potions. The module further includes a first scan driver configured to sequentially apply scan signals to each of the first and second scan line groups. The first scan driver is further configured to substantially simultaneously apply the scan signals to corresponding scan lines of the first and second scan line groups. The module also includes a first data driver configured to output first data voltages to the first data line group and a second data driver configured to output second data voltages to the second data line group with the same timing as the first data driver.

23 Claims, 10 Drawing Sheets

(52) U.S. Cl.
CPC ..... *G09G 2310/0218* (2013.01); *G09G 2310/0281* (2013.01)

(56) References Cited

U.S. PATENT DOCUMENTS

| | | | | |
|---|---|---|---|---|
| 2008/0165110 | A1* | 7/2008 | Kim | H01L 27/1214 345/99 |
| 2011/0164023 | A1* | 7/2011 | Ko | G09G 3/3225 345/212 |
| 2011/0292041 | A1* | 12/2011 | Lee | G09G 3/342 345/419 |
| 2013/0300781 | A1* | 11/2013 | Lee | G09G 3/3406 345/691 |
| 2014/0071107 | A1* | 3/2014 | Hong | G09G 3/3291 345/211 |
| 2014/0204069 | A1* | 7/2014 | Chien | G09G 3/3291 345/212 |
| 2015/0042634 | A1* | 2/2015 | Jin | G09G 3/3648 345/212 |
| 2015/0279332 | A1* | 10/2015 | Hu | G09G 3/003 345/213 |

FOREIGN PATENT DOCUMENTS

| | | | |
|---|---|---|---|
| KR | 10-1153740 | B1 | 5/2012 |
| KR | 20130097369 | A * | 9/2013 |

* cited by examiner

DISPLAY PANEL MODULE, ORGANIC LIGHT-EMITTING DIODE (OLED) DISPLAY AND METHOD OF DRIVING THE SAME

CROSS REFERENCE TO RELATED APPLICATION

This application claims priority under 35 U.S.C. §119 to Korean Patent Application No. 10-2014-0068473 filed on Jun. 5, 2014, the disclosure of which is hereby incorporated by reference herein in its entirety.

BACKGROUND

Field

The described technology generally relates to display panel modules, organic light-emitting diode (OLED) displays and methods of driving the same.

Description of the Related Technology

Various types of flat panel displays have been developed having a reduced weight and volume compared to traditional displays. Examples of these flat panel display technologies include liquid crystal displays (LCDs), field emission displays (FEDs), plasma display panel (PDP) displays, organic light-emitting diode (OLED) displays, etc. OLED displays have advantages over other similar display technologies such as fast response speeds and low power consumption since these displays include OLEDs that emit light due to the recombination of electrons and holes.

SUMMARY OF CERTAIN INVENTIVE ASPECTS

One aspect is a display panel module capable of reducing the required number of driving integrated circuits (ICs).

Another aspect is an OLED display including a display panel module capable of reducing the required number of driving ICs.

Another aspect is a method of driving an OLED display including a display panel module capable of reducing the required number of driving ICs.

Another aspect is a display panel module including a display panel, a first scan driving unit, a first data driving unit and a second data driving unit. The display panel includes a first portion and a second portion and a plurality of pixels being arranged in the display panel. The first scan driving unit sequentially scans a first scan line group arranged in the first portion and sequentially scans a second scan line group arranged in the second portion from a scan start point. The first scan driving unit applies a scan signal simultaneously to a first scan line of the first scan line group and a second scan line of the second scan line group, the second scan line corresponds to the first scan line and the first scan line group and the second scan line group are simultaneously scanned. The first data driving unit outputs first data voltages to a first data line group arranged at the first portion. The second data driving unit outputs second data voltages to a second data line group arranged at the second portion with the same driving timing as the first data driving unit.

In example embodiments, the first portion may be an upper portion of the display panel and the second portion may be a lower portion of the display panel.

In example embodiments, the display panel module may further include a second scan driving unit that scans the first scan line group and the second scan line group with the same driving timing as the first scan driving unit from the scan start point.

The display panel may be defined by a first long side, a second long side, a first short side and a second short side. The first long side and the second long side may have the same first length and the first short side and the second short side may have the same second length which is smaller than the first length. The first scan driving unit may be arranged adjacent to the first short side and the second scan driving unit may be arranged adjacent to the second short side.

The first scan driving unit may be arranged more closely to the first portion than to the second portion and the second scan driving unit may be arranged more closely to the first portion than to the second portion.

The first scan driving unit may include at least a first scan driving integrated circuit (IC) that applies first scan signals simultaneously to the first scan line group and the second scan line group and the second scan driving unit may include at least a second scan driving IC that applies second scan signals simultaneously to the first scan line group and the second scan line group with the same driving timing as the first scan driving unit.

The first scan driving unit may include at least a first scan driving IC and a second scan driving IC which apply first scan signals simultaneously to the first scan line group and the second scan line group and the second scan driving unit comprises at least a third scan driving IC and a fourth scan driving IC which apply second scan signals simultaneously to the first scan line group and the second scan line group with the same driving timing as the first scan driving unit.

The first scan driving unit may be arranged more closely to the first portion than to the second portion and the second scan driving unit may be arranged more closely to the second portion than to the first portion.

The first scan driving unit may include at least a first scan driving integrated circuit (IC) that applies first scan signals simultaneously to the first scan line group and the second scan line group and the second scan driving unit may include at least a second scan driving IC that applies second scan signals simultaneously to the first scan line group and the second scan line group with the same driving timing as the first scan driving unit.

The first scan driving unit may include at least a first scan driving IC and a second scan driving IC which apply first scan signals simultaneously to the first scan line group and the second scan line group and the second scan driving unit comprises at least a third scan driving IC and a fourth scan driving IC which apply second scan signals simultaneously to the first scan line group and the second scan line group with the same driving timing as the first scan driving unit.

The first data driving unit may be arranged adjacent to the first long side and the second data driving unit may be arranged adjacent to the second long side. The first data driving unit may include a plurality of first data driving ICs that output the first data voltages to the first data line group and the second data driving unit may include a plurality of second data driving ICs that output the second data voltages to the second data line group.

In example embodiments, each of the pixels arranged in the first portion may include a switching transistor that has a first terminal connected to each of the first data line group, a gate terminal connected to each of the first scan line group and a second terminal connected to a first node; a storage capacitor connected between a high power supply voltage and the first node; a driving transistor that has a first terminal connected to the high power supply voltage, a gate terminal connected to the first node and a second terminal; and an OLED connected between the second terminal of the driving transistor and a low power supply voltage.

Another aspect is an OLED display including a display panel, a first scan driving unit, a second scan driving unit, a first data driving unit, a second data driving unit, a power unit and a timing controller. The display panel includes a first portion and a second portion and a plurality of pixels being arranged in the display panel. The first scan driving unit sequentially scans a first scan line group arranged in the first portion and sequentially scans a second scan line group arranged in the second portion from a scan start point. The first scan driving unit applies a scan signal simultaneously to a first scan line of the first scan line group and a second scan line of the second scan line group, the second scan line corresponds to the first scan line and the first scan line group and the second scan line group are simultaneously scanned. The second scan driving unit scans the first scan line group and the second scan line group with the same driving timing as the first scan driving unit. The first data driving unit outputs first data voltages to a first data line group arranged at the first portion. The second data driving unit outputs second data voltages to a second data line group arranged at the second portion with the same driving timing as the first data driving unit. The power unit provides the display panel with a high power supply voltage and a low power supply voltage. The timing controller controls the first scan driving unit, the second scan driving unit, the first data driving unit, the second data driving unit and the power unit.

In example embodiments, the first portion may be an upper portion of the display panel and the second portion may be a lower portion of the display panel. The display panel may be defined by a first long side, a second long side, a first short side and a second short side. The first long side and the second long side may have the same first length and the first short side and the second short side may have the same second length which is smaller than the first length. The first scan driving unit may be arranged adjacent to the first short side and the second scan driving unit may be arranged adjacent to the second short side.

The first scan driving unit may be arranged more closely to the first portion than to the second portion and the second scan driving unit may be arranged more closely to the second portion than to the first portion.

The first scan driving unit may be arranged more closely to the first portion than to the second portion and the second scan driving unit may be arranged more closely to the first portion than to the second portion.

The first scan driving unit may include at least a first scan driving IC and a second scan driving IC which apply first scan signals simultaneously to the first scan line group and the second scan line group and the second scan driving unit comprises at least a third scan driving IC and a fourth scan driving IC which apply second scan signals simultaneously to the first scan line group and the second scan line group with the same driving timing as the first scan driving unit.

In example embodiments, the timing controller may generate first and second scan control signals which control the first and second scan driving units respectively, first and second data control signals which control the first and second data driving units respectively and a power control signal which controls the power unit, based on input control signal that is externally provided, and the timing controller may generate first and second data signals which are provided to the first and second data driving units respectively, based on input image signal that is externally provided.

In example embodiments, each of the pixels arranged in the first portion may include a switching transistor that has a first terminal connected to each of the first data line group, a gate terminal connected to each of the first scan line group and a second terminal connected to a first node; a storage capacitor connected between a high power supply voltage and the first node; a driving transistor that has a first terminal connected to the high power supply voltage, a gate terminal connected to the first node and a second terminal; and an OLED connected between the second terminal of the driving transistor and a low power supply voltage.

According to example embodiments, a method of driving an OLED display includes scanning simultaneously a first scan line group and a second scan line group from a scan start point by a first scan driving unit and a second scan driving unit, the first scan line group being arranged at a first portion of a display panel, the second scan line group being arranged at a second portion of the display panel; outputting first data voltages to a first data line group arranged at the first portion of the display panel by a first data driving unit; and outputting second data voltages to a second data line group arranged at the second portion of the display panel by a second data driving unit with the same driving timing as the first data driving unit.

Another aspect is a display panel module comprising a display panel including a plurality of pixels, wherein the display panel is divided into a first portion and a second portion; a plurality of scan lines divided into first and second scan line groups and connected to the pixels, wherein the first scan line group is arranged in the first portion and the second scan line group is arranged in the second portion; a first scan driver configured to sequentially apply scan signals to each of the first and second scan line groups, wherein the first scan driver is further configured to substantially simultaneously apply the scan signals to corresponding scan lines of the first and second scan line groups; a plurality of data lines divided into first and second data line groups and connected to the pixels, wherein the first data line group is arranged in the first portion and the second data line group is arranged in the second portion; a first data driver configured to output first data voltages to the first data line group; and a second data driver configured to output second data voltages to the second data line group with the same timing as the first data driver.

In example embodiments, the first portion is an upper portion of the display panel and the second portion is a lower portion of the display panel. The display panel module can further comprise a second scan driver configured to scan the first scan line group and the second scan line group with the same timing as the first scan driver. The display panel can further include a first long side, a second long side, a first short side and a second short side, wherein the first and second long sides have substantially the same length, wherein the first and second short sides have substantially the same length which is less than that of the first and second long sides and wherein the first scan driver is arranged adjacent to the first short side and the second scan driver is arranged adjacent to the second short side. The first scan driver can be arranged closer to the first portion than to the second portion and wherein the second scan driver is arranged closer to the first portion than to the second portion.

In example embodiments, the first scan driver comprises at least a first scan integrated circuit (IC) configured to apply first scan signals to the first scan line group and the second scan line group and wherein the second scan driver comprises at least a second scan IC configured to apply second scan signals to the first scan line group and the second scan line group with the same timing as the first scan driver. The first scan driver can comprise at least a first scan integrated circuit (IC) and a second scan IC configured to apply first scan signals to the first scan line group and the second scan line group and the second scan driver can comprise at least a third scan IC and a fourth scan IC configured to apply second scan signals to the first scan line group and the second scan line group with the same timing as the first scan driver. The first scan driver can be arranged closer to the first portion than to the second portion and the second scan driver can be arranged closer to the second portion than to the first portion.

In example embodiments, the first scan driver comprises at least a first scan integrated circuit (IC) configured to apply first scan signals to the first scan line group and the second scan line group and wherein the second scan driver comprises at least a second scan IC configured to apply second scan signals to the first scan line group and the second scan line group with the same timing as the first scan driving unit. The first scan driver can comprise at least a first scan integrated circuit (IC) and a second scan IC configured to apply first scan signals to the first scan line group and the second scan line group and the second scan driver can comprise at least a third scan IC and a fourth scan IC configured to apply second scan signals to the first scan line group and the second scan line group with the same timing as the first scan driving unit.

In example embodiments, the first data driver is arranged adjacent to the first long side and the second data driver is arranged adjacent to the second long side, wherein the first data driver comprises a plurality of first data integrated circuits (ICs) configured to output the first data voltages to the first data line group and wherein the second data driver comprises a plurality of second data ICs configured to output the second data voltages to the second data line group. Each of the pixels arranged in the first portion can comprise a switching transistor comprising: i) a first terminal connected to a data line of the first data line group, ii) a gate terminal connected to a scan line of the first scan line group and iii) a second terminal connected to a first node; a storage capacitor connected between a high power supply voltage and the first node; a driving transistor comprising: i) a first terminal connected to the high power supply voltage, ii) a gate terminal connected to the first node and iii) a second terminal; and an organic light-emitting diode (OLED) connected between the second terminal of the driving transistor and a low power supply voltage.

Another aspect is an OLED display comprising a display panel including a plurality of pixels, wherein the display panel is divided into a first portion and a second portion; a plurality of scan lines divided into first and second scan line groups and connected to the pixels, wherein the first scan line group is arranged in the first portion and the second scan line group is arranged in the second portion; a first scan driver configured to sequentially apply scan signals to each of the first and second scan line groups, wherein the first scan driver is further configured to substantially simultaneously apply the scan signals to corresponding scan lines of the first and second scan line groups; a second scan driver configured to scan the first and second scan line groups with the same timing as the first driver; a plurality of data lines divided into first and second data line groups and connected to the pixels, wherein the first data line group is arranged in the first portion and the second data line group is arranged in the second portion; a first data driver configured to output first data voltages to the first data line group; a second data driver configured to output second data voltages to the second data line group; a power supply configured to supply a high power supply voltage and a low power supply voltage to the display panel; and a timing controller configured to control the first scan driver, the second scan driver, the first data driver, the second data driver and the power supply.

In example embodiments the first portion is an upper portion of the display panel and the second portion is a lower portion of the display panel, wherein the display panel includes a first long side, a second long side, a first short side and a second short side, wherein the first and second long sides have substantially the same length, wherein the first and second short sides have substantially the same length which is less than that of the first and second long sides and wherein the first scan driver is arranged adjacent to the first short side and the second scan driver is arranged adjacent to the second short side. The first scan driver can be arranged closer to the first portion than to the second portion and the second scan driver can be arranged closer to the first portion than to the second portion. The first scan driver can be arranged closer to the first portion than to the second portion and the second scan driver can be arranged closer to the second portion than to the first portion.

In example embodiments the first scan driver comprises at least a first scan integrated circuit (IC) and a second scan IC configured to substantially simultaneously apply first scan signals to the first scan line group and the second scan line group and wherein the second scan driver comprises at least a third scan IC and a fourth scan IC configured to substantially simultaneously apply second scan signals to the first scan line group and the second scan line group with the same timing as the first scan driving unit. The timing controller can be configured to generate: i) first and second scan control signals which respectively control the first and second scan drivers, ii) first and second data control signals which respectively control the first and second data drivers, and iii) a power control signal which controls the power supply and the timing controller can be further configured to generate each of the control signals based on an input control signal received from an external source and the timing controller can be further configured to: i) generate first and second data signals based on an input image signal received from the external source and ii) respectively apply the first and second data signals to the first and second data drivers.

In example embodiments each of the pixels arranged in the first portion comprises a switching transistor comprising: i) a first terminal connect to a data line of the first data line group, ii) a gate terminal connected to a scan line of the first scan line group and iii) a second terminal connected to a first node; a storage capacitor connected between a high power supply voltage and the first node; a driving transistor comprising: i) a first terminal connected to the high power supply voltage, ii) a gate terminal connected to the first node and iii) a second terminal; and an OLED connected between the second terminal of the driving transistor and a low power supply voltage.

Another aspect is a method of driving an OLED display comprising first and second scan drivers substantially simultaneously scanning a plurality of pixels via a first scan line group and a second scan line group, wherein the first scan line group is arranged in a first portion of a display panel of the OLED display and wherein the second scan line group is arranged a second portion of the display panel; a first data driver outputting first data voltages to the pixels in the first portion via a first data line group; and a second data driver outputting second data voltages to the pixels in the second portion via a second data line group with the same driving timing as the first data driver.

Accordingly, according to at least one embodiment, the number of scan driving ICs can be reduced by at least one scan driver simultaneously scanning a first scan line group arranged in a first portion of a display panel and a second scan line group arranged in a second portion of the display panel.

DETAILED DESCRIPTION OF CERTAIN INVENTIVE EMBODIMENTS

Figure 1:
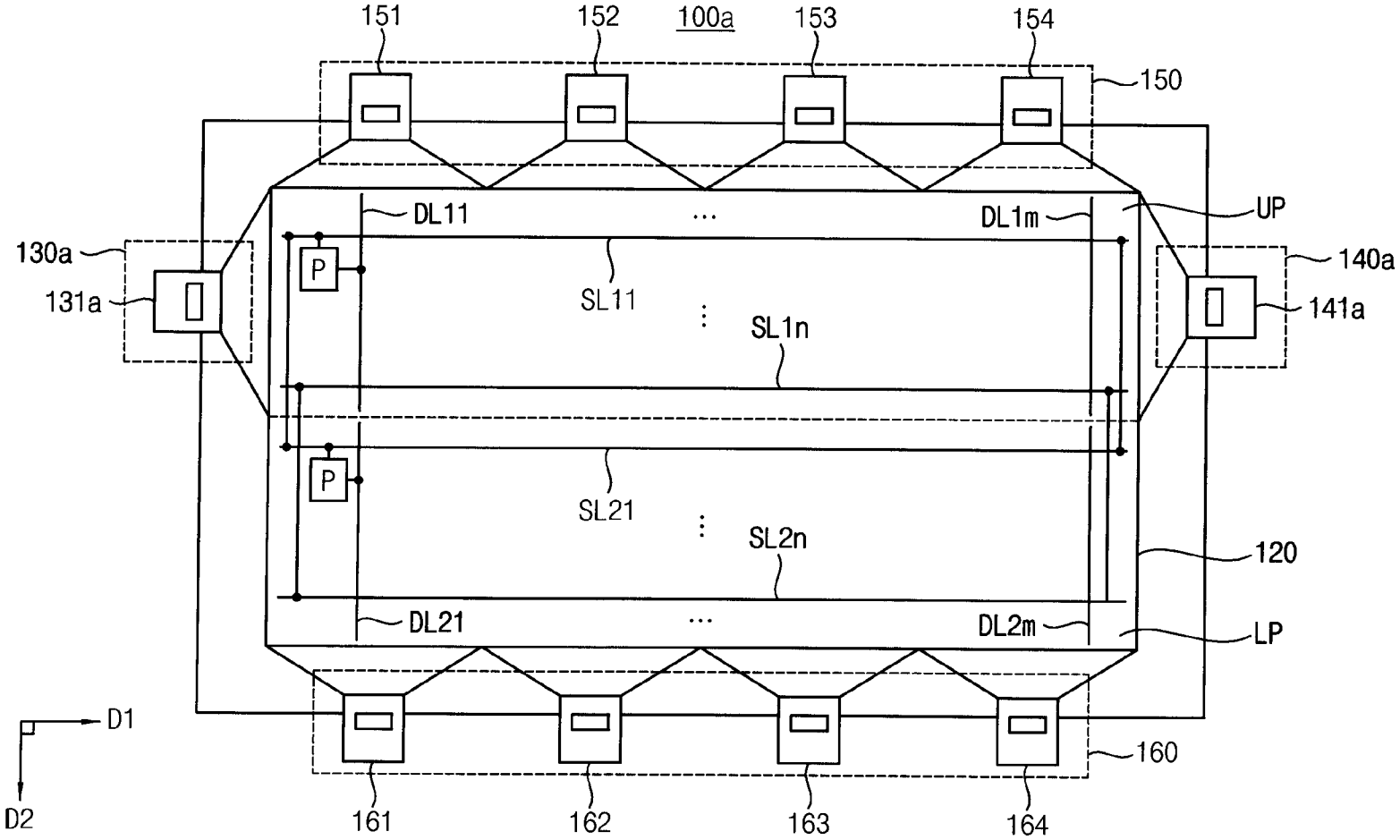
FIG. 1 is a block diagram illustrating a display panel module according to example embodiments.

As the size of OLED displays increases, the display panel may have to be divided into an upper portion and a lower portion to properly drive the display. When a display is divided in this way, the number of driving integrated circuits or signal drivers must be increased to separately drive each of the portions.

The example embodiments are described more fully hereinafter with reference to the accompanying drawings. The described technology may, however, be embodied in many different forms and should not be construed as limited to the example embodiments set forth herein. In the drawings, the sizes and relative sizes of layers and regions may be exaggerated for the sake of clarity.

It will be understood that when an element or layer is referred to as being "on," "connected to" or "coupled to" another element or layer, it can be directly on, connected or coupled to the other element or layer or intervening elements or layers may also be present. In contrast, when an element is referred to as being "directly on," "directly connected to" or "directly coupled to" another element or layer, there are no intervening elements or layers present. Like or similar reference numerals refer to like or similar elements throughout. As used herein, the term "and/or" includes any and all combinations of one or more of the associated listed items.

It will be understood that, although the terms first, second, third etc. may be used herein to describe various elements, components, regions, layers, patterns and/or sections, these elements, components, regions, layers, patterns and/or sections should not be limited by these terms.

The terminology used herein is for the purpose of describing particular example embodiments only and is not intended to be limiting of the described technology. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross sectional illustrations that are schematic illustrations of illustratively idealized example embodiments (and intermediate structures) of the described technology. As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. The regions illustrated in the figures are schematic in nature and their shapes are not intended to illustrate the actual shape of a region of a device and are not intended to limit the scope of the described technology.

Unless otherwise defined, all terms (including technical and scientific terms) used herein have the same meaning as commonly understood by one of ordinary skill in the art to which this described technology belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display panel module according to example embodiments.

Referring to FIG. 1, a display panel module 100*a* may include a display panel 120, first and second scan driving units or scan drivers 130*a* and 140*a* and first and second data driving units or data drivers 150 and 160.

Figure 6:
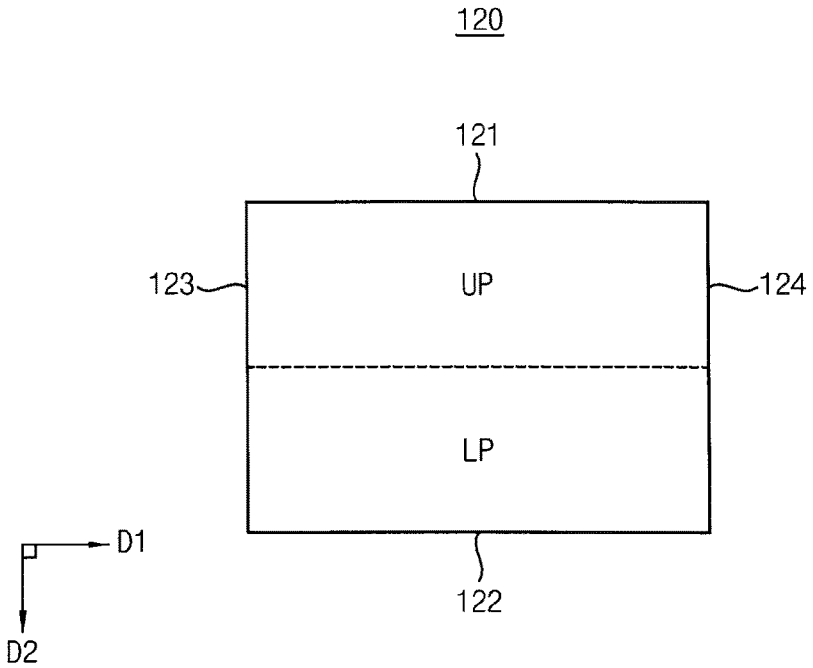
FIG. 6 illustrates a display panel in the display panel module of FIG. 1.

FIG. 6 illustrates an example display panel included in the display panel module of FIG. 1.

Referring to FIG. 6, the display panel 120 has first and second long sides 121 and 122 which extend in a first direction D1 and first and second short sides 123 and 124 which extend in a second direction D2 substantially perpendicular to the first direction D1. The first and second long sides 121 and 122 have substantially the same first length and the first and second short sides 123 and 124 have substantially the same second length that is shorter than the first length.

Referring back to FIG. 1, the display panel 120 includes a first portion UP which corresponds to an upper portion of the display panel 120 and a second portion LP which corresponds to a lower portion of the display panel 120. A driving timing of the first portion UP may be substantially the same as a driving timing of the second portion LP. The display panel 120 includes a plurality of gate lines, a plurality of data lines and a plurality of pixels P connected to the gate lines and the data lines. The gate lines extend in the first direction D1 and the data lines extend in a second direction D2 crossing the first direction D1.

A first scan line group SL11~SL1*n* and a first data line group DL11~DL1*m* are arranged in the first portion UP of the display panel 120. A second scan line group SL21~SL2*n* and a second data line group DL21~DL2*m* are arranged in the second portion LP of the display panel 120.

The first scan driving unit 130*a* is placed adjacent to the first short side 123 of the display panel 120. The first scan driving unit 130*a* sequentially scans the first scan line group SL11~SL1*n* and sequentially scans the second scan line group SL21~SL2*n* substantially simultaneously with the first scan line group SL11~SL1*n*. In some embodiments, the first scan driving unit 130*a* is arranged more closely to the first portion UP than to the second portion LP. The first scan driving unit 130*a* includes at least a first scan driving integrated circuit (IC) 131*a* that applies the scan signals sequentially to the first scan line group SL11~SL1*n* and to the second scan line group SL21~SL2*n* simultaneously.

The second scan driving unit 140*a* is placed adjacent to the second short side 124 of the display panel 120. The second scan driving unit 140*a* scans the first scan line group SL11~SL1*n* and the second scan line group SL21~SL2*n* with the same driving timing as the first scan driving unit 130*a*. In some embodiments, the second scan driving unit 140*a* is arranged more closely to the first portion UP than to the second portion LP. The second scan driving unit 140*a* includes at least a second scan driving IC 141*a* that applies scan signals sequentially to the first scan line group SL11~SL1*n* and to the second scan line group SL21~SL2*n* simultaneously.

The first and second scan driving ICs 131*a* and 141*a* respectively apply scan signals to the same scan lines in opposite directions in order to prevent the voltage level of the scan signal from dropping due to the length of the scan lines. This voltage drop increases and the time available for applying each scan signal decreases as the size of the display panel 120 increases.

The first data driving unit 150 is placed adjacent to the first long side 121 of the display panel 120. The first data driving unit 150 outputs first data voltages to the first data line group DL11~DL1*m* arranged in the first portion UP. The first data driving unit 150 includes a plurality of first data driving ICs 151~154 and each of the first data driving ICs 151~154 outputs the respective first data voltages to the first data line group DL11~DL1*m* in a plurality of channels. The first data driving ICs 151~154 are not connected to the second data line group DL21~DL2*m* arranged in the second portion LP.

The second data driving unit 160 is placed adjacent to the second long side 122 of the display panel 120. The second data driving unit 160 outputs second data voltages to the second data line group DL21~DL2*m* arranged in the second portion LP. The second data driving unit 160 includes a plurality of second data driving ICs 161~164 and each of the second data driving ICs 161~164 outputs the respective second data voltages to the second data line group DL21~DL2*m* in a plurality of channels. The second data driving ICs 161~164 are not connected to the first data line group DL11~DL1*m* arranged in the first portion UP.

In the display panel module 100*a* of FIG. 1, the first scan driving unit 130*a* includes at least the first scan driving IC 131*a* and the first scan driving unit 130*a* applies a scan signal to one scan line SL11 of the first scan line group SL11~SL1*n* and a corresponding one scan line SL21 of the second scan line group SL21~SL2*n* when the first scan driving unit 130*a* sequentially scans the first scan line group SL11~SL1*n* and the second scan line group SL21~SL2*n* simultaneously. The second scan driving unit 140*a* includes at least the second scan driving IC 141*a* and the second scan driving unit 140*a* sequentially scans the first scan line group SL11~SL1*n* and the second scan line group SL21~SL2*n* simultaneously with the same driving timing as the first scan driving unit 130*a*.

In example embodiments, the first and second driving units 130*a* and 140*a* and the first and second data driving units 150 and 160 are connected to the display panel 120 by a chip-on flexible printed circuit (COF), a chip-on glass (COG), a flexible printed circuit (FPC), etc.

Figure 2:
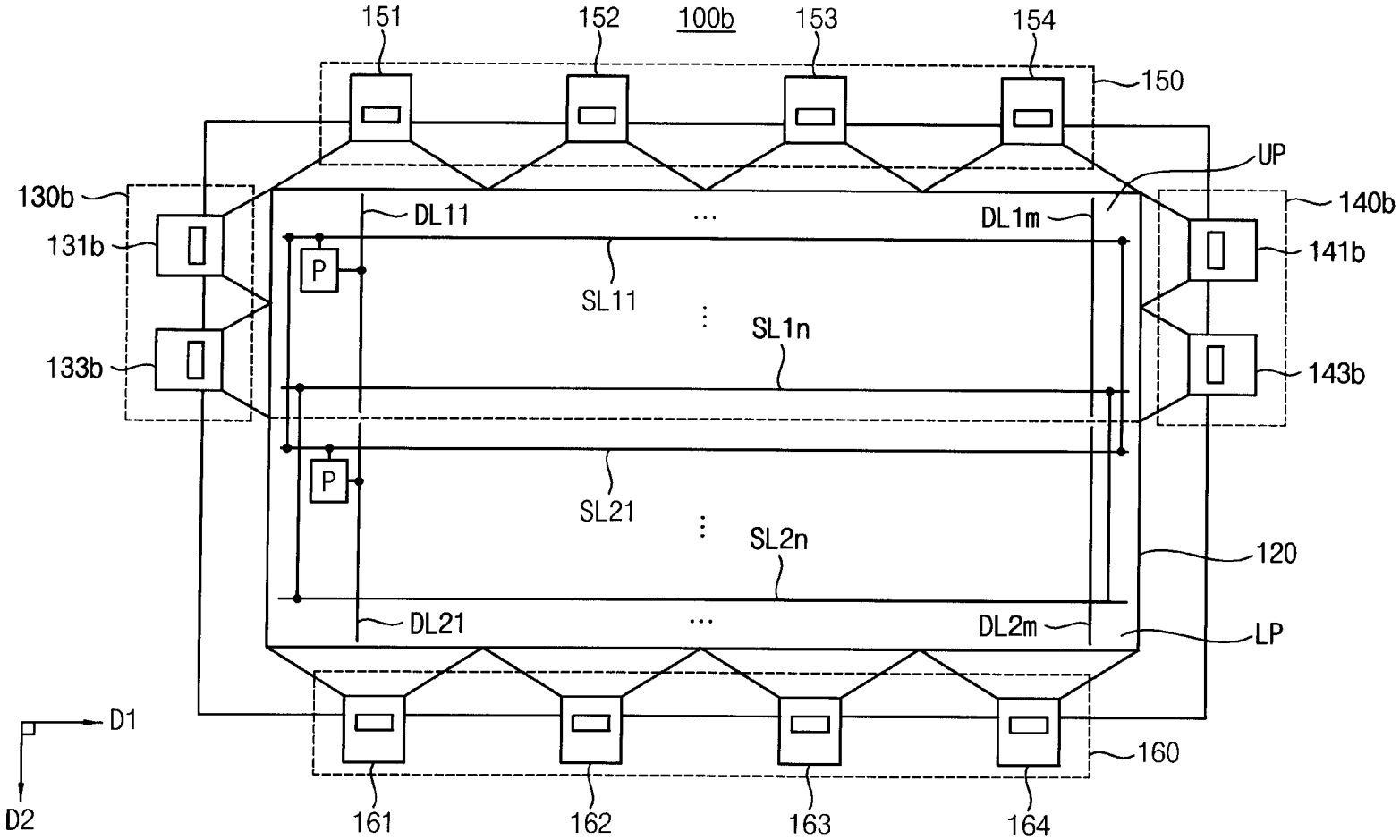
FIG. 2 is a block diagram illustrating another display panel module according to example embodiments.

FIG. 2 is a block diagram illustrating another display panel module according to example embodiments.

Referring to the embodiment of FIG. 2, the display panel module 100*b* includes a display panel 120, first and second scan driving units 130*b* and 140*b* and first and second data driving units 150 and 160.

The display panel module 100*b* of FIG. 2 differs from the display panel module 100*a* of FIG. 1 in that the first scan driving unit 130*b* includes first and second scan driving ICs 131*b* and 133*b* placed adjacent to the first short side 123 and the second scan driving unit 140*b* includes third and fourth scan driving ICs 141*b* and 143*b* placed adjacent to the second short side 124. Description of the display panel 120 and the first and second data driving unit 150 and 160 is substantially same as the description with reference to FIG. 1.

The first and second scan driving ICs 131*b* and 133*b* apply a scan signal to one scan line SL11 of the first scan line group SL11~SL1*n* and a corresponding one scan line SL21 of the second scan line group SL21~SL2*n* when the first and second scan driving ICs 131*b* and 133*b* sequentially scan the first scan line group SL11~SL1*n* and the second scan line group SL21~SL2*n* simultaneously via a plurality of channels. The third and fourth scan driving ICs 141*b* and 143*b* sequentially scan the first scan line group SL11~SL1*n* and the second scan line group SL21~SL2*n* simultaneously with the same driving timing as the first and second scan driving ICs 131*b* and 133*b*.

In example embodiments, the first and second driving units 130*b* and 140*b* and the first and second data driving units 150 and 160 are connected to the display panel 120 by a chip-on flexible printed circuit (COF), a chip-on glass (COG), a flexible printed circuit (FPC), etc.

Figure 3:
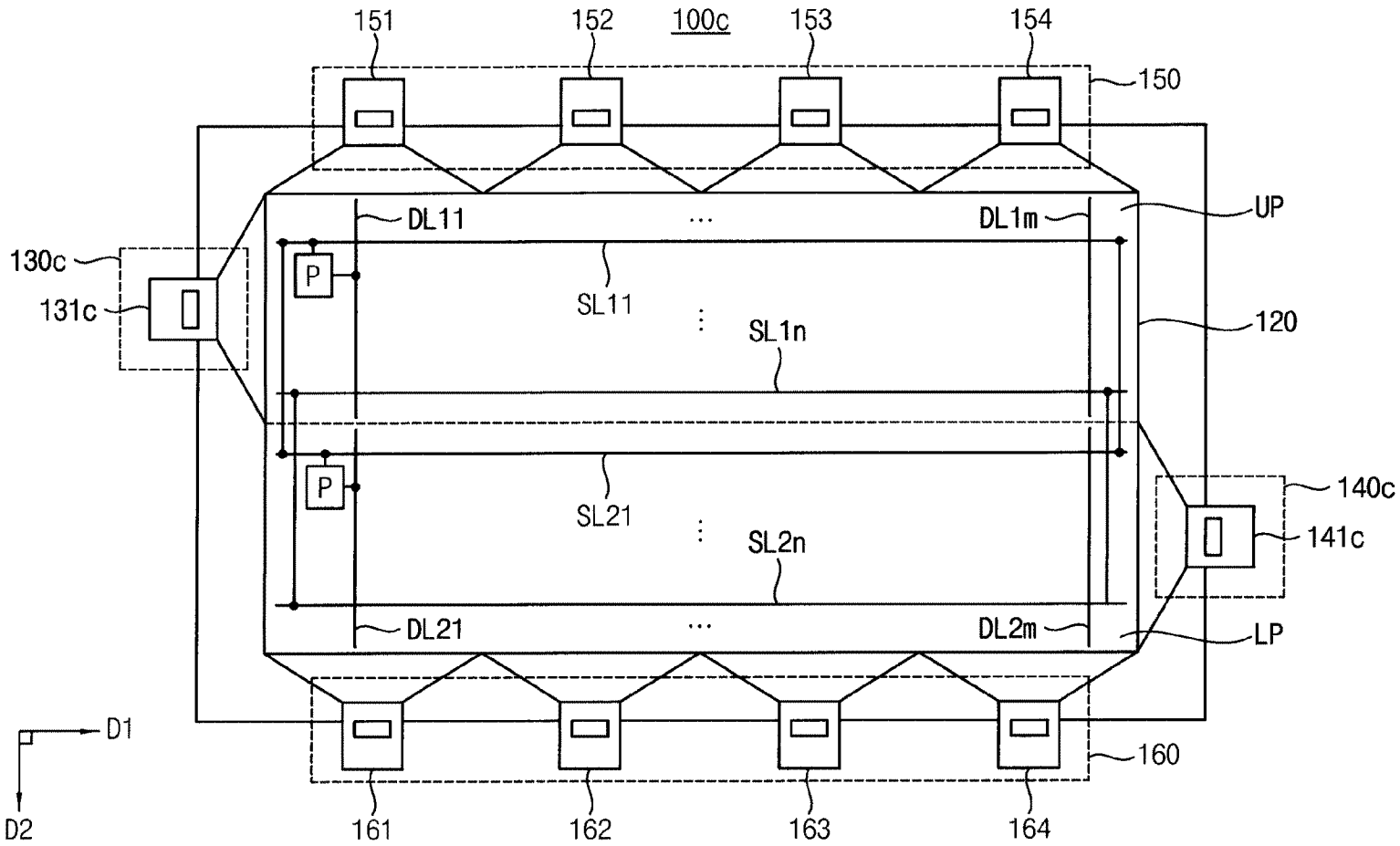
FIG. 3 is a block diagram illustrating still another display panel module according to example embodiments.

FIG. 3 is a block diagram illustrating still another display panel module according to example embodiments.

Referring to FIG. 3, a display panel module 100*c* includes a display panel 120, first and second scan driving units 130*c* and 140*c* and first and second data driving units 150 and 160. The first scan driving IC 130*c* includes a first scan driving IC 131*c* and the second scan driving unit 140*c* includes a second scan driving IC 141*c*.

The display panel module 100*c* of FIG. 3 differs from the display panel module 100*a* of FIG. 1 in that the second scan driving unit 140*c* including the second scan driving IC 141*c* is arranged more closely to the second portion LP than to the first portion UP for load balancing. Description on the display panel 120 and the first and second data driving unit 150 and 160 is substantially same as the description with reference to FIG. 1.

In the display panel module 100*c* of FIG. 3, the first scan driving unit 130*c* includes at least the first scan driving IC 131*c* and the first scan driving unit 130*c* applies a scan signal to one scan line SL11 of the first scan line group SL11~SL1*n* and a corresponding one scan line SL21 of the second scan line group SL21~SL2*n* when the first scan driving unit 130*c* sequentially scans the first scan line group SL11~SL1*n* and the second scan line group SL21~SL2*n* simultaneously. The second scan driving unit 140*c* includes at least the second scan driving IC 141*c* and the second scan driving unit 140*c* sequentially scans the first scan line group SL11~SL1*n* and the second scan line group SL21~SL2*n* simultaneously with the same driving timing as the first scan driving unit 130*c*.

In example embodiments, the first and second driving units 130*c* and 140*c* and the first and second data driving units 150 and 160 are connected to the display panel 120 by a chip-on flexible printed circuit (COF), a chip-on glass (COG), a flexible printed circuit (FPC), etc.

Figure 4:
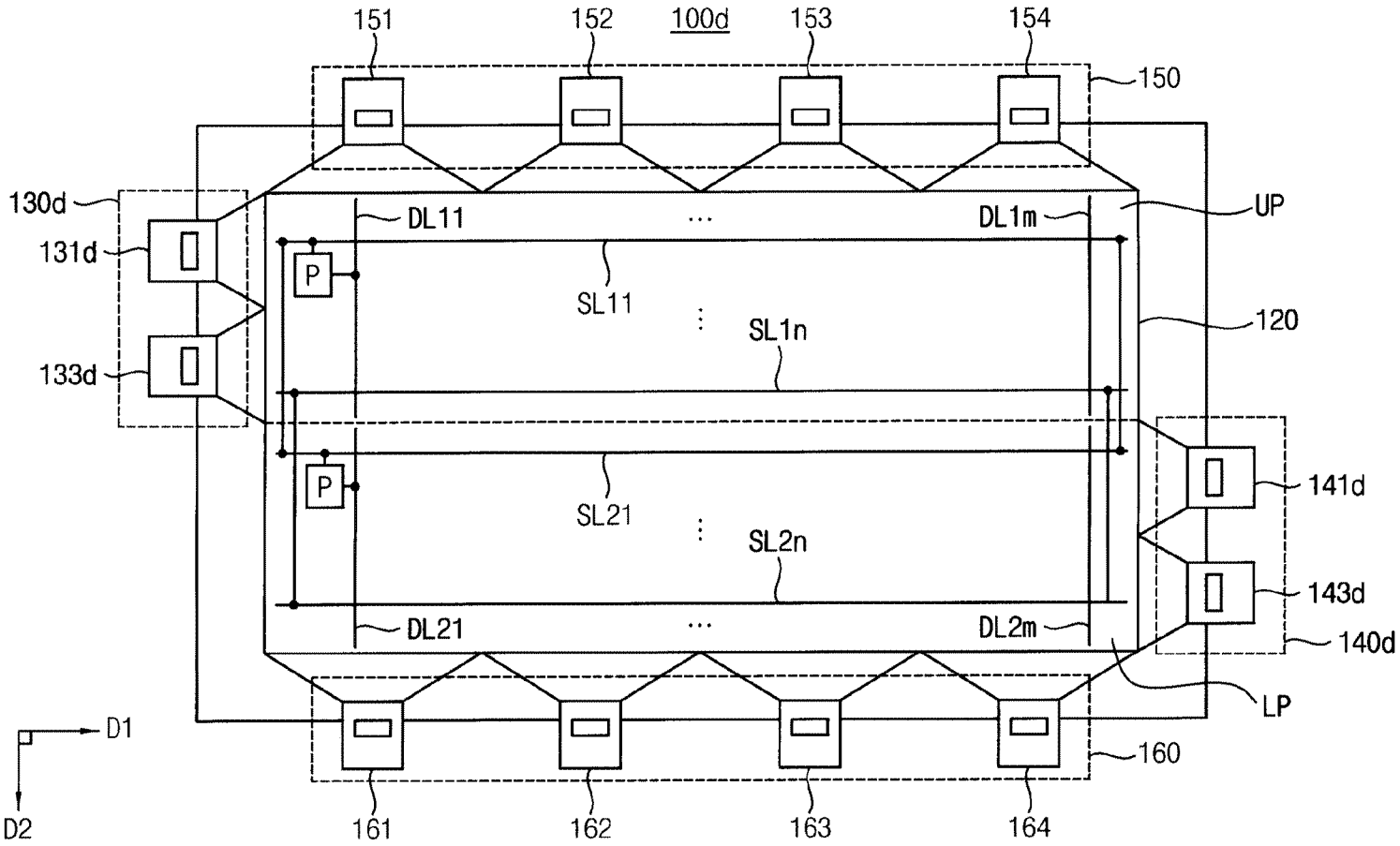
FIG. 4 is a block diagram illustrating yet another display panel module according to example embodiments.

FIG. 4 is a block diagram illustrating still another display panel module according to example embodiments.

Referring to the embodiment of FIG. 4, the display panel module 100*d* includes a display panel 120, first and second scan driving units 130*d* and 140*d* and first and second data driving units 150 and 160.

The display panel module 100*d* of FIG. 4 differs from the display panel module 100*c* of FIG. 3 in that the first scan driving unit 130*d* includes first and second scan driving ICs 131*d* and 133*d* placed adjacent to the first short side 123 and the second scan driving unit 140*d* includes third and fourth scan driving ICs 141*d* and 143*d* placed adjacent to the second short side 124. Description of the display panel 120 and the first and second data driving unit 150 and 160 is substantially same as the description with reference to FIG. 1.

The first and second scan driving ICs 131*d* and 133*d* apply a scan signal to one scan line SL11 of the first scan line group SL11~SL1*n* and a corresponding one scan line SL21 of the second scan line group SL21~SL2*n* when the first and second scan driving ICs 131*d* and 133*d* sequentially scan the first scan line group SL11~SL1*n* and the second scan line group SL21~SL2*n* simultaneously via a plurality of channels. The third and fourth scan driving ICs 141*d* and 143*d* sequentially scan the first scan line group SL11~SL1*n* and the second scan line group SL21~SL2*n* simultaneously with the same driving timing as the first and second scan driving ICs 131*d* and 133*d*.

In example embodiments, the first and second driving units 130*d* and 140*d* and the first and second data driving units 150 and 160 are connected to the display panel 120 by a chip-on flexible printed circuit (COF), a chip-on glass (COG), a flexible printed circuit (FPC), etc.

Although, each of the display panel modules 100*a*, 100*b*, 100*c* and 100*d* in FIGS. 1 through 4, includes first and second scan driving units, the display panel module may include one scan driving unit depending on the size of the display panel.

Figure 5:
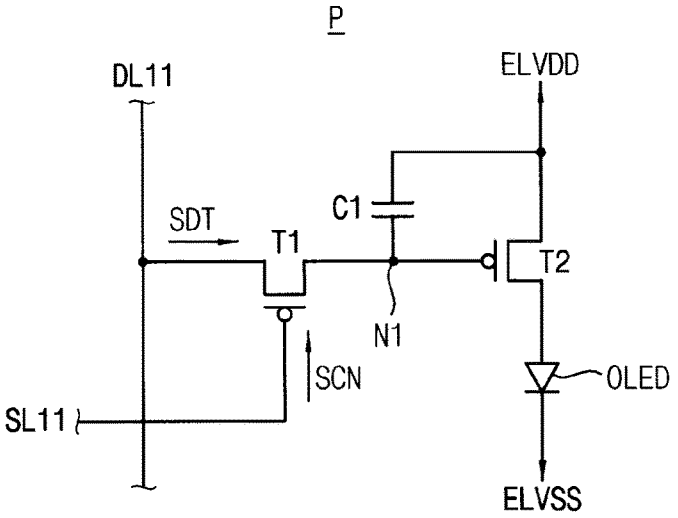
FIG. 5 is a circuit diagram illustrating one of the pixels included in the display panel according to example embodiments.

FIG. 5 is a circuit diagram illustrating one of pixels included in the display panel according to example embodiments.

Referring to FIGS. 1 through 5, the pixel P includes a switching transistor T1, a driving transistor T2, a storage capacitor C1 and an organic light-emitting diode (OLED).

In some embodiments, the switching transistor T1 is a p-channel metal-oxide semiconductor (PMOS) transistor that has a first terminal connected to a data line DL11 to receive a data voltage SDT, a gate terminal connected to a scan line SL11 to receive a scan signal SCN and a second terminal connected to a first node N1. In these embodiments, the driving transistor T2 is a PMOS transistor that has a first terminal connected to a high power supply voltage ELVDD, a gate terminal connected to the first node N1 and a second terminal connected to a low power supply voltage ELVSS. The storage capacitor C1 has a first terminal connected to the high power supply voltage ELVDD and a second terminal connected to the first node N1. The OLED has an anode electrode connected to the second terminal of the driving transistor T2 and a cathode electrode connected to the low power supply voltage ELVSS.

The switching transistor T1 transfers the data voltage SDT to the storage capacitor C1 in response to the scan signal SCN and the OLED emits light in response to the data voltage SDT stored in the storage capacitor C1 to display images.

In example embodiments, the pixels P of the display panel 120 are driven in a digital driving method. In the digital driving method, the driving transistor T2 is operated as a switch in a linear region. Accordingly, the driving transistor T2 is driven to be in either a turned-on state or a turned-off state.

To turn on or turn off the driving transistor T2, the data voltage SDT is supplied with one of two levels including a turn-on level and a turn-off level. In the digital driving method, the pixel is in one of the turned-on state and the turned-off state and each frame is divided into a plurality of subfields to represent the various possible grayscales. The sum of the sub-fields where the pixel P is turned on determines the brightness of the pixel P such that the various grayscales can be represented.

Figure 7:
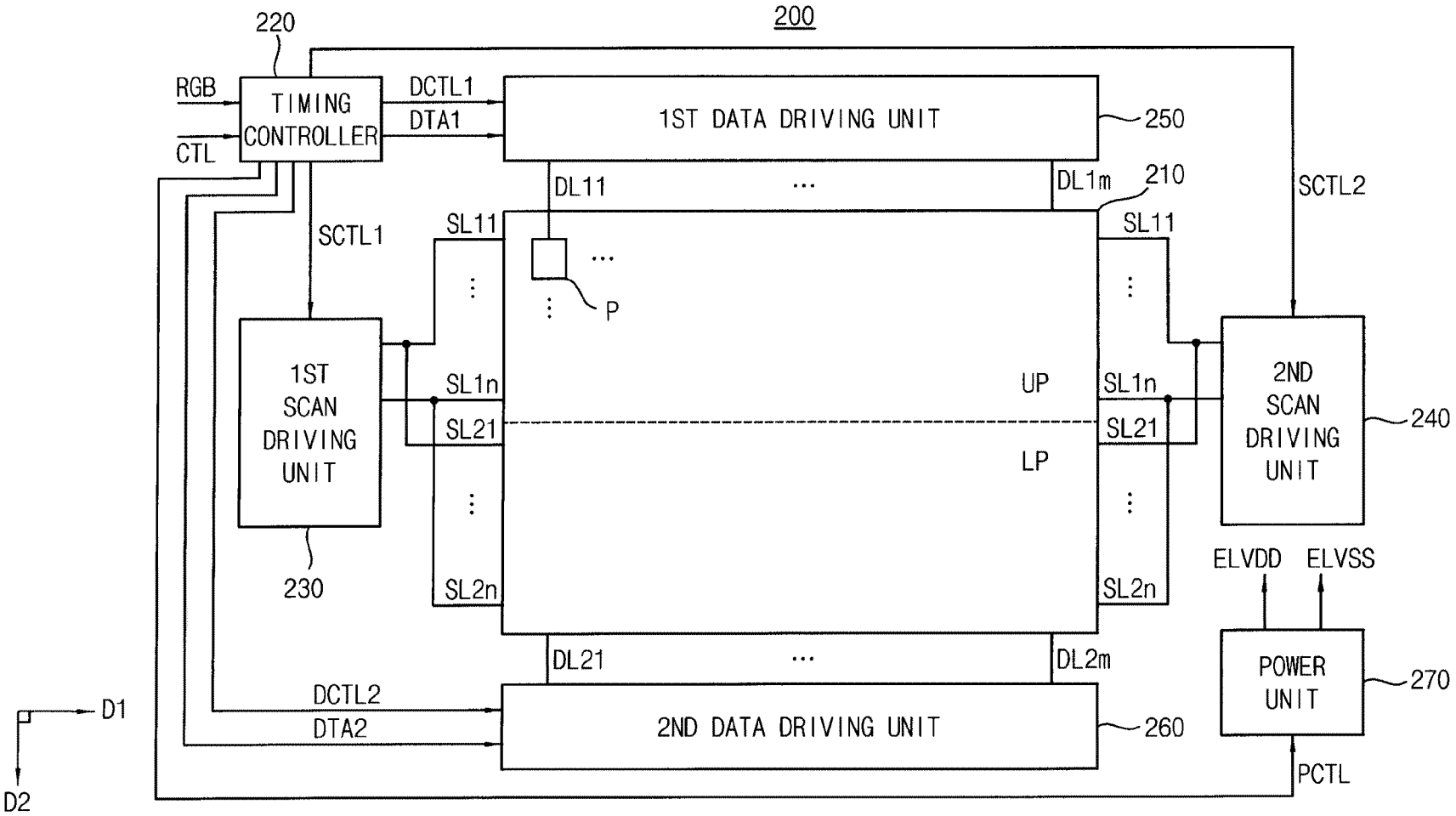
FIG. 7 is a block diagram illustrating an OLED display according to example embodiments.

FIG. 7 is a block diagram illustrating an OLED display according to example embodiments.

Referring to FIG. 7, the OLED display 200 includes a display panel 210, a timing controller 220, a first scan driving unit 230, a second scan driving unit 240, a first data driving unit 250, a second data driving unit 260 and a power unit or power supply 270.

As described with reference to FIGS. 1 through 4, the first scan driving unit 230, the second scan driving unit 240, the first data driving unit 250, the second data driving unit 260 and the power unit 270 are connected to the display panel 120 by a chip-on flexible printed circuit (COF), a chip-on glass (COG), a flexible printed circuit (FPC), etc., and can be integrated with a display panel module together with the display panel 210.

A plurality of pixels P are arranged in the display panel 210 and the display panel 210 includes a first portion UP and a second portion LP. The display panel 210 includes first and second long sides which extend in a first direction D1 and first and second short sides which extend in a second direction D2 substantially perpendicular to the first direction D1 as described with reference to FIG. 6. A first scan line group SL11~SL1*n* and a first data line group DL11~DL1*m* connected to pixels P is arranged in the first portion UP of the display panel 210. A second scan line group SL21~SL2*n* and a second data line group DL21~DL2*m* connected to pixels P is arranged in the second portion LP of the display panel 210.

The first scan driving unit 230 is placed adjacent to the first short side of the display panel 210. The first scan driving unit 230 is arranged more closely to the first portion UP than to the second portion LP as described with reference to FIGS. 1 through 4. In example embodiments, the first scan driving unit 230 includes one or more scan driving ICs as described with reference to FIGS. 1 through 4.

The second scan driving unit 240 is placed adjacent to the second short side of the display panel 210. The second scan driving unit 240 is arranged more closely to the first portion UP than to the second portion LP as described with reference to FIGS. 1 and 2. In other embodiments, the second scan driving unit 240 is arranged more closely to the second portion LP than to the first portion UP as described with reference to FIGS. 3 and 4. In example embodiments, the second scan driving unit 240 includes one or more scan driving ICs as described with reference to FIGS. 1 through 4.

Each of the first and second scan driving units 230 and 240 is commonly connected to the first scan line group SL11~SL1*n* and the second scan line group SL21~SL2*n*. The first scan driving unit 230 includes at least one scan driving IC and applies a scan signal to one scan line SL11 of the first scan line group SL11~SL1*n* and a corresponding one scan line SL21 of the second scan line group SL21~SL2*n* when the first scan driving unit 130*a* sequentially scans the first scan line group SL11~SL1*n* and the second scan line group SL21~SL2*n* simultaneously. The second scan driving unit 240 includes at least one scan driving IC and sequentially scans the first scan line group SL11~SL1*n* and the second scan line group SL21~SL2*n* simultaneously with the same driving timing as the first scan driving unit 230.

The first data driving unit 250 is placed adjacent to the first long side of the display panel 210. The first data driving unit 250 outputs first data voltages to the first data line group DL11~DL1*m* formed in the first portion UP. The first data driving unit 250 includes a plurality of first data driving ICs and each of the first data driving ICs outputs the first data voltages to the first data line group DL11~DL1*m* via a plurality of channels. The first data driving ICs are not connected to the second data line group DL21~DL2*m* formed in the second portion LP.

The second data driving unit 260 is placed adjacent to the second long side of the display panel 210. The second data driving unit 260 outputs second data voltages to the second data line group DL21~DL2*m* formed in the second portion LP. The second data driving unit 260 includes a plurality of second data driving ICs and each of the second data driving ICs output the second data voltages to the second data line group DL21~DL2*m* via a plurality of channels. The second data driving ICs are not connected to the first data line group DL11~DL1*m* formed in the first portion UP.

The power unit 270 provides the high power supply voltage ELVDD and the low power supply voltage ELVSS to the display panel 210.

The timing controller 220 receives input image data RGB and an input control signal CTL from an external graphic controller or external source (not illustrated). The input image data RGB can include red image data R, green image data G and blue image data B. The input image data RGB can include an active duration when active data is inputted and a vertical blank duration when the active data is not inputted and which corresponds to a duration between frames. The input control signal CTL may include a master clock signal and a data enable signal. The input control signal CTL may further include a vertical synchronization signal and a horizontal synchronization signal.

The timing controller 220 generates a first scan control signal SCTL1, a second scan control signal SCTL2, a first data control signal DCTL1, a second data control signal DCTL2 and a voltage control signal PCTL based on the input image data RGB and the input control signal CTL.

The timing controller 220 generates the first scan control signal SCTL1 for controlling the operation of the first scan driving unit 230 based on the input control signal CTL and outputs the first scan control signal SCTL1 to the first scan driver unit 230. The timing controller 220 generates the second scan control signal SCTL2 for controlling the operation of the second scan driving unit 240 based on the input control signal CTL and outputs the second scan control signal SCTL2 to the second scan driver unit 240. The first and second scan control signals SCTL1 and SCTL2 may include a vertical start signal and a gate clock signal.

The timing controller 220 generates the first data control signal DCTL1 for controlling the operation of the first data driving unit 250 based on the input control signal CTL and outputs the first data control signal DCTL1 to the first data driver unit 250. The timing controller 220 generates the second data control signal DCTL2 for controlling the operation of the second data driving unit 260 based on the input control signal CTL and outputs the second data control signal DCTL2 to the second data driver unit 260. The first and second data control signals DCTL1 and DCTL2 includes a horizontal start signal and a load signal.

The timing controller 220 generates a first data signal DTA1 corresponding to the first portion UP of the display panel 210 based on the input image data RGB and outputs the first data signal DTA1 to the first data driving unit 250. The timing controller 220 generates a second data signal DTA2 corresponding to the second portion LP of the display panel 210 based on the input image data RGB and outputs the second data signal DTA to the second data driving unit 260.

The timing controller 220 generates the voltage control signal PCTL for controlling the operation of the power unit 270 and outputs the voltage control signal PCTL to the power unit 270.

Each of the first and second scan driving units 230 and 240 is commonly connected to the first scan line group SL11~SL1*n* and the second scan line group SL21~SL2*n*. Each of the first and second scan driving units 230 and 240 generates scan signals for scanning the first scan line group SL11~SL1*n* and the second scan line group SL21~SL2*n* based on each of the first and second scan control signals SCTL1 and SCTL2.

Each of the first and second scan driving units 230 and 240 sequentially outputs the scan signals to the first scan line group SL11~SL1*n* and the second scan line group SL21~SL2*n* simultaneously.

The first data driving unit 250 receives the first data control signal DCTL1 and the first data signal DTA1 from the timing controller 220, converts the first data signal DTA1 to the first data voltage and outputs the first data voltage to the first data line group DL11~DL1*m*. The second data driving unit 260 receives the second data control signal DCTL2 and the second data signal DTA2 from the timing controller 220, converts the second data signal DTA2 to the second data voltage and outputs the second data voltage to the second data line group DL21~DL2*m* with the same driving timing as the first data driving unit 250.

The power unit 270 outputs the high power supply voltage ELVDD and the low power supply voltage ELVSS to the display panel 210 in response to the voltage control signal VCTL from the timing controller 220.

Figure 8:
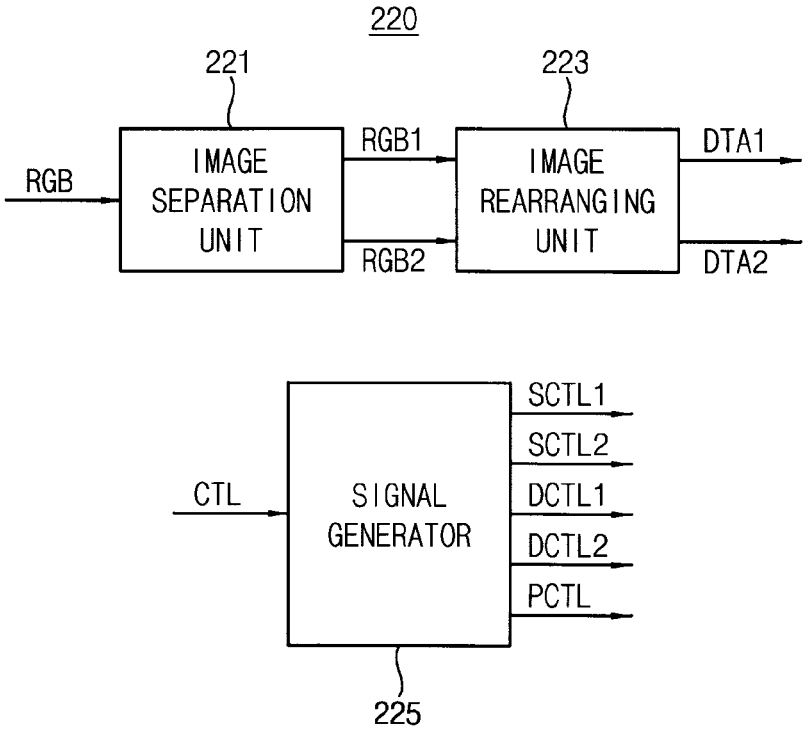
FIG. 8 is a block diagram illustrating the timing controller in FIG. 7 according to example embodiments.

FIG. 8 is a block diagram illustrating the timing controller in FIG. 7 according to example embodiments.

Referring to FIGS. 7 and 8, the timing controller 220 includes an image separation unit 221, an image rearranging unit 223 and a signal generator 225.

The image separation unit 221 receives the input image data RGB. The image separation unit 221 divides the input image data RGB into a first image data RGB1 and a second image data RGB2. The first image data RGB1 corresponds to the first portion UP of the display panel 210. The second image data RGB2 corresponds to the second portion LP of the display panel 210. The image separation unit 221 outputs the first image data RGB1 and the second image data RGB2 to the image rearranging unit 223.

The image rearranging unit 223 rearranges the first image data RGB1 in a data type of the first data driving unit 250 to generate the first data signal DTA1. The image rearranging unit 223 rearranges the second image data RGB2 in a data type of the second data driving unit 260 to generate the second data signal DTA2. The image rearranging unit 223 outputs the first data signal DTA1 to the first data driving unit 250. The image rearranging unit 223 outputs the second data signal DTA2 to the second data driving unit 260.

The timing controller 220 further includes an image compensating unit that compensates the first image data RGB1 and the second image data RGB2. The image compensating unit may include an adaptive color correction ("ACC") portion (not illustrated) and/or a dynamic capacitance compensating ("DCC") portion (not illustrated).

The ACC unit receives grayscale data of the first and second image data RGB1 and RGB2 and performs the adaptive color correction. The ACC unit may compensate the grayscale data using a gamma curve.

The DCC unit performs the dynamic capacitance compensation to compensate grayscale data of a present frame data using a previous frame data and the present frame data.

The signal generator 225 receives the input control signal CTL. The signal generator 225 generates the first scan control signal SCTL1 that controls a driving timing of the first scan driving unit 230 and the second scan control signal SCTL that controls a driving timing of the second scan driving unit 240 based on the input control signal CTL. The signal generator 225 generates the first data control signal DCTL1 that controls a driving timing of the first data driving unit 250 and the second data control signal DCTL2 that controls a driving timing of the second data driving unit 260 based on the input control signal CTL. In addition, the signal generator 225 generates the voltage control signal PCTL that generates the power unit 270 based on the input control signal CTL. The first scan control signal SCTL1 may be substantially same as the second scan control signal SCTL2.

The signal generator 225 outputs the first scan control signal SCTL1 to the first scan driving unit 230, outputs the second scan control signal SCTL2 to the second scan driving unit 240, outputs the first data control signal DCTL1 to the first data driving unit 250, outputs the second data control signal DCTL2 to the second data driving unit 260 and outputs the power control signal PCTL to the power unit 270.

Figure 9:
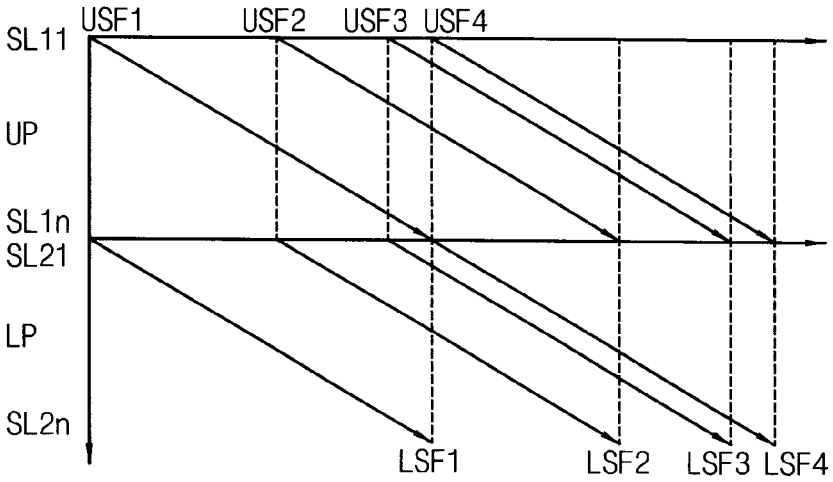
FIG. 9 is a conceptual diagram illustrating driving timings of the first portion and the second portion of the display panel in FIG. 7.

FIG. 9 is a conceptual diagram illustrating driving timings of the first portion and the second portion of the display panel in FIG. 7.

Figure 10:
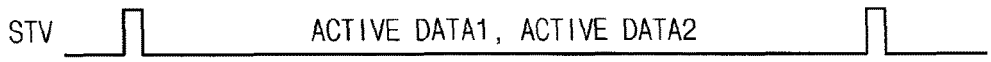
FIG. 10 is a timing diagram illustrating vertical start signals applied to the first and second scan driving units in FIG. 7.

FIG. 10 is a timing diagram illustrating vertical start signals applied to the first and second scan driving units in FIG. 7.

Figure 11:
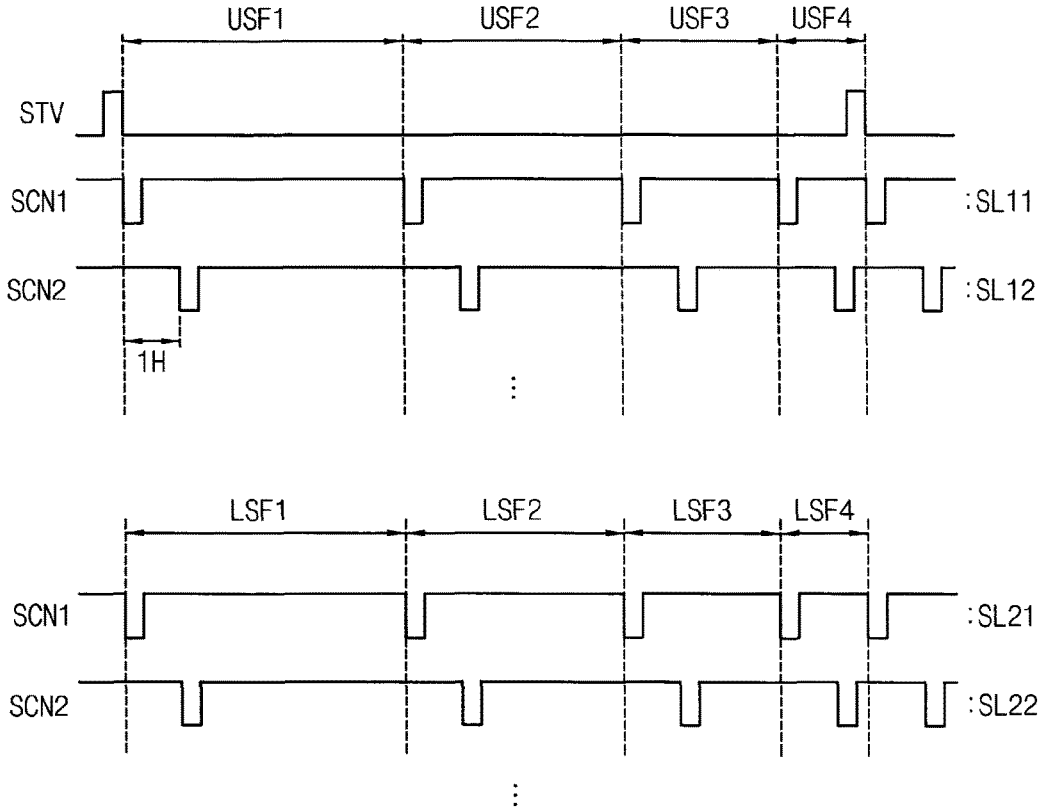
FIG. 11 is a timing diagram illustrating input signals and output signals of the first and second scan driving units in FIG. 7.

FIG. 11 is a timing diagram illustrating input signals and output signals of the first and second scan driving units in FIG. 7.

Referring to FIGS. 7 through 11, the first scan driving unit 230 sequentially scans the first scan line group SL11~SL1*n* arranged in the first portion UP and sequentially scans the second scan line group SL21~SL2*n* arranged in the second portion LP simultaneously. The second scan driving unit 240 sequentially scans the first scan line group SL11~SL1*n* arranged in the first portion UP and sequentially scans the second scan line group SL21~SL2*n* arranged in the second portion LP simultaneously with the same driving timing as the first scan driving unit 230. The first data driving unit 250 outputs the first data voltages to the first data line group DL11~DL1*m* arranged in the first portion UP in synchronization with scanning of the first and second scan driving units 230 and 240. The second data driving unit 260 outputs the second data voltages to the second data line group DL21~DL2*m* arranged in the second portion LP in synchronization with scanning of the first and second scan driving units 230 and 240.

The pixels P of the display panel 210 are driven in a digital driving method. In addition, the pixels P of the display panel 210 are driven in a progressive emission method. A single frame is divided into a plurality of subfields.

In an example embodiment, the single frame is divided into four subfields SF0, SF1, SF2 and SF3. In addition, four subfields SF1, SF2, SF3 and SF4 are generated to represent binary numbers so that the durations of four subfields SF1, SF2, SF3 and SF4 have a ratio of 8:4:2:1. However, the described technology is not limited the number of the subfields or the duration of the subfields described above.

A scan start point of the second portion LP is substantially same as a scan start point of the first portion UP and a vertical start signal STV is substantially same for the first and second scan driving units 230 and 240. The vertical start signal STV may be a base for generating the scan signals of the first and second scan driving units 230 and 240.

In the example embodiment, the single frame is divided into four subfields so that a width W1 of a gate pulse is approximately ¼ of a horizontal time 1H. For each of the subfields USF1, USF2, USF3 and USF4 of the first portion UP and for each of the subfields LSF1, LSF2, LSF3 and LSF4 of the second portion LP, the same scan signal SCN1 is applied to the scan line SL11 of the first portion UP and the scan line SL21 of the second portion LP and the same scan signal SCN2 is applied to the scan line SL12 of the first portion UP and the scan line SL22 of the second portion LP.

Figure 12:
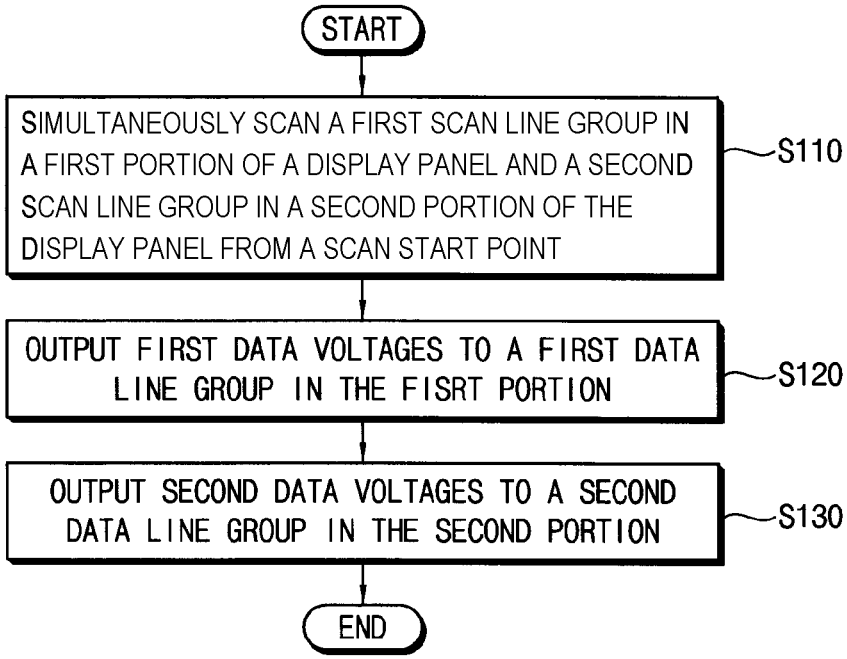
FIG. 12 is a flow chart illustrating a method of driving an OLED display according to example embodiments.

FIG. 12 is a flow chart illustrating a method of driving an OLED display according to example embodiments.

Referring to FIGS. 7 and 9 through 12, the first scan line group SL11~SL1*n* and the second scan line group SL21~SL2*n* are simultaneously scanned from a scan start point by the first scan driving unit 230 and the second scan driving unit 240 (S 110). The first scan line group SL11~SL1*n* is arranged in the first portion UP of the display panel 210 and the second scan line group SL21~SL2*n* is arranged in the second portion LP of the display panel 210. Each of the first and second scan driving unit 230 and 240 is commonly connected to the first scan line group SL11~SL1*n* and the second scan line group SL21~SL2*n* and operates with the same driving timing. The first data voltages are output to the first data line group DL11~DL1*m* arranged at the first portion UP of the display panel 210 by the first data driving unit 250 in synchronization with the scanning of the first and second scan driving unit 230 and 240 (S120). The second data voltages are output to the second data line group DL21~DL2*m* arranged at the second portion LP of the display panel 210 by the second data driving unit 260 synchronization with the scanning of the first and second scan driving unit 230 and 240 with the same driving timing as the first data driving unit 250 (S130).

Figure 13:
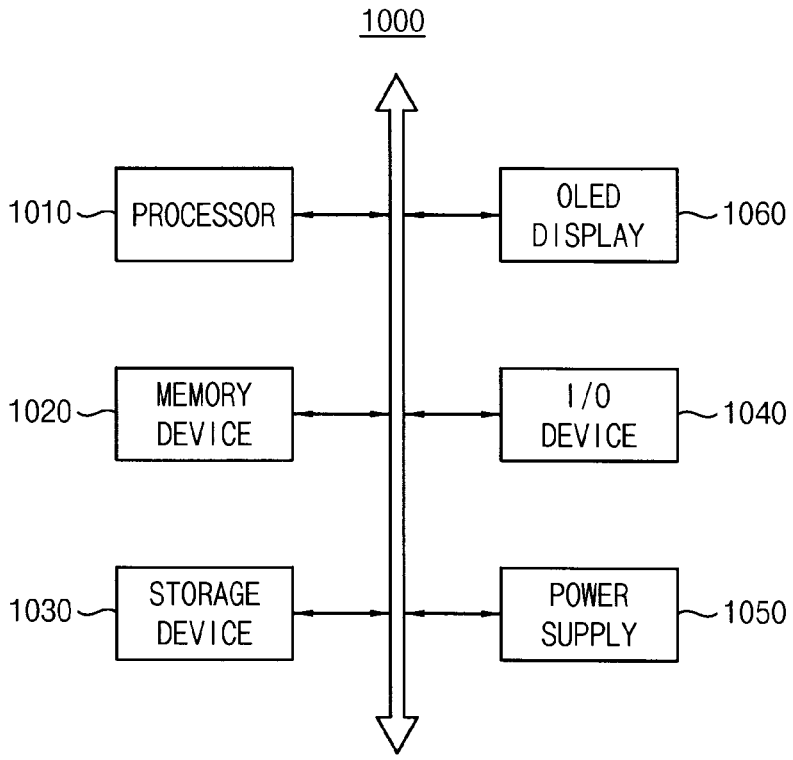
FIG. 13 is a block diagram illustrating an electronic system including an OLED display according to example embodiments.

FIG. 13 is a block diagram illustrating an electronic system including an OLED display according to example embodiments.

Referring to FIG. 13, the electronic system 1000 includes a processor 1010, a memory device 1020, a storage device 1030, an input/output (I/O) device 1040, a power supply 1050, and an OLED display 1060. The electronic system 1000 may further include a plurality of ports for communicating with, for example, a video card, a sound card, a memory card, a universal serial bus (USB) device, other electronic systems, etc.

The processor 1010 may perform various computing functions or tasks. The processor 1010 may be for example, a microprocessor, a central processing unit (CPU), etc. The processor 1010 may be connected to other components via an address bus, a control bus, a data bus, etc. Further, the processor 1010 may be connected to an extended bus such as a peripheral component interconnection (PCI) bus.

The memory device 1020 may store data for operations of the electronic system 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1030 may be, for example, a solid state drive (SSD) device, a hard disk drive (HDD) device, a CD-ROM device, etc. The I/O device 1040 may be, for example, an input device such as a keyboard, a keypad, a mouse, a touch screen, etc., and/or an output device such as a printer, a speaker, etc. The power supply 1050 may supply power for operations of the electronic system 1000. The OLED display 1060 communicate with other components via the buses or other communication links.

The OLED display 1060 may include the OLED display 200 of FIG. 7. The OLED display 1060 may include a first scan driving unit arranged adjacent to a first short side of a display panel and a second scan driving unit arranged adjacent to a second short side of the display panel. The first scan driving unit may sequentially scan a first scan line group arranged in a first portion of the display panel and a second scan line group arranged in a second portion of the display panel simultaneously. The first scan driving unit may scan the first and second scan line groups with the same driving timing as the first scan driving unit. Therefore, the OLED display 1060 can reduce the number of scan driving ICs when the display panel including the first and second portion is driven by a dual scan scheme.

The present embodiments may be applied to any electronic system 1000 having the OLED display 1060. For example, the present embodiments may be applied to the electronic system 1000, such as a television, a computer monitor, a laptop, a digital camera, a cellular phone, a smart phone, a personal digital assistant (PDA), a portable multimedia player (PMP), a MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of invention as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The invention is to be defined by the following claims, with equivalents of the claims to be included therein.

What is claimed is:

1. A display panel module, comprising:

a display panel including a plurality of pixels, wherein the display panel is divided into a first portion and a second portion;

a plurality of scan lines divided into first and second scan line groups and connected to the pixels, wherein the first scan line group is arranged in the first portion and the second scan line group is arranged in the second portion;

a first scan driver configured to sequentially apply scan signals to each of the first and second scan line groups, wherein the first scan driver is further configured to substantially simultaneously apply the scan signals to corresponding scan ones of the first and second scan line groups, such that the first scan driver outputs a plurality of scan signals sequentially, and each of the plurality of scan signals is a single scan signal that is output by the first scan driver and then provided to both of one of the scan lines in the first scan line group and a corresponding one of the scan lines in the second scan line group simultaneously at a point of common connection;

a plurality of data lines divided into first and second data line groups and connected to the pixels, wherein the first data line group is arranged in the first portion and the second data line group is arranged in the second portion;

a first data driver configured to output first data voltages to the first data line group; and a second data driver configured to output second data voltages to the second data line group with the same timing as the first data driver, wherein the pixels are driven in a progressive emission method such that a single frame is divided into four subfields and durations of the four subfields have a ratio of 8:4:2:1 respectively.

2. The display panel module of claim 1, wherein the first portion is an upper portion of the display panel and the second portion is a lower portion of the display panel.

3. The display panel module of claim 1, further comprising:

a second scan driver configured to scan the first scan line group and the second scan line group with the same timing as the first scan driver, wherein the second scan driver respectively applies scan signals to the same scan lines as the first scan driver but in opposite directions.

4. The display panel module of claim 3, wherein the display panel further includes a first long side, a second long side, a first short side and a second short side, wherein the first and second long sides have substantially the same length, wherein the first and second short skies have substantially the same length which is less than that of the first and second long sides and wherein the first scan driver is arranged adjacent to the first short side and the second scan driver is arranged adjacent to the second short side.

5. The display panel module of claim 4, wherein the first scan driver is arranged closer to the first portion than to the second portion and wherein the second scan driver is arranged closer to the first portion than to the second portion.

6. The display panel module of claim 5, wherein the first scan driver comprises at least a first scan integrated circuit (IC) configured to apply first scan signals to the first scan line group and the second scan line group and wherein the second scan driver comprises at least a second scan IC configured to apply second scan signals to the first scan line group and the second scan line group with the same timing as the first scan driver.

7. The display panel module of claim 5, wherein the first scan driver comprises at least a first scan integrated circuit (IC) and a second scan IC configured to apply first scan signals to the first scan line group and the second scan line group and wherein the second scan driver comprises at least a third scan IC and a fourth scan IC configured to apply second scan signals to the first scan line group and the second scan line group with the same timing as the first scan driver.

8. A display panel module, comprising:

a display panel including a plurality of pixels, wherein the display panel is divided into a first portion and a second portion;

a plurality of scan lines divided into first and second scan line groups and connected to the pixels, wherein the first scan line group is arranged in the first portion and the second scan line group is arranged in the second portion;

a first scan driver configured to sequentially apply scan signals to each of the first and second scan line groups, wherein the first scan driver is further configured to substantially simultaneously apply the scan signals to corresponding scan lines of the first and second scan line groups;

a plurality of data lines divided into first and second data line groups and connected to the pixels, wherein the first data line group is arranged in the first portion and the second data line group is arranged in the second portion;

a first data driver configured to output first data voltages to the first data line group;

a second data driver configured to output second data voltages to the second data line group with the same timing as the first data driver; and a second scan driver configured to scan the first scan line group and the second scan line group with the same timing as the first scan driver, wherein the display panel further includes a first long side, a second long side, a first short side and a second short side, wherein the first and second long sides have substantially the same length, wherein the first and second short sides have substantially the same length which is less than that of the first and second long sides and wherein the first scan driver is arranged adjacent to the first short side and the second scan driver is arranged adjacent to the second short side, wherein the first scan driver is arranged closer to the first portion than to the second portion and wherein the second scan driver is arranged closer to the second portion than to the first portion.

9. The display panel module of claim 8, wherein the first scan driver comprises at least a first scan integrated circuit (IC) configured to apply first scan signals to the first scan line group and the second scan line group and wherein the second scan driver comprises at least a second scan IC configured to apply second scan signals to the first scan fine group and the second scan line group with the same timing as the first scan driver.

10. The display panel module of claim 8, wherein the first scan driver comprises at least a first scan integrated circuit (IC) and a second scan IC configured to apply first scan signals to the first scan line group and the second scan line group and wherein the second scan driver comprises at least a third scan IC and a fourth scan IC configured to apply second scan signals to the first scan line group and the second scan line group with the same timing as the first scan driver.

11. The display panel module of claim 4, wherein the first data driver is arranged adjacent to the first long side and the second data driver is arranged adjacent to the second long side, wherein the first data driver comprises a plurality of first data integrated circuits (ICs) configured to output the first data voltages to the first data line group, and wherein the second data driver comprises a plurality of second data ICs configured to output the second data voltages to the second data line group.

12. The display panel module of claim 1, wherein each of the pixels arranged in the first portion comprises:

a switching transistor comprising: i) a first terminal connected to a data line of the first data line group, ii) a gate terminal connected to a scan line of the first scan line group and iii) a second terminal connected to a first node;

a storage capacitor connected between a high power supply voltage and the first node;

a driving transistor comprising:) a first terminal connected to the high power supply voltage, a gate terminal connected to the first node and iii) a second terminal; and an organic light-emitting diode (OLED) connected between the second terminal of the driving transistor and a low power supply voltage.

13. An organic light-emitting diode (OLED) display, comprising the display panel module of claim 1, wherein the display panel module further comprises:

a second scan driver configured to scan the first and second scan line groups with the same timing as the first driver;

a power supply configured to supply a high power supply voltage and a low power supply voltage to the display panel; and a timing controller configured to control the first scan driver, the second scan driver, the first data driver, the second data driver and the power supply.

14. The OLED display of claim 13, wherein the first portion is an upper portion of the display panel and the second portion is a lower portion of the display panel, wherein the display panel includes a first long side, a second long side, a first short side and a second short side, wherein the first and second long sides have substantially the same length, wherein the first and second short sides have substantially the same length which is less than that of the first and second long sides and wherein the first scan driver is arranged adjacent to the first short side and the second scan driver is arranged adjacent to the second short side.

15. The OLED display of claim 14, wherein the first scan driver is arranged closer to the first portion than to the second portion and wherein the second scan driver is arranged closer to the first portion than to the second portion.

16. The OLED display of claim 14, wherein the first scan driver is arranged closer to the first portion than to the second portion and wherein the second scan driver is arranged closer to the second portion than to the first portion.

17. The OLED display of claim 14, wherein the first scan driver comprises at least a first scan integrated circuit (IC) and a second scan IC configured to substantially simultaneously apply first scan signals to the first scan line group and the second scan line group and wherein the second scan driver comprises at least a third scan IC and a fourth scan IC configured to substantially simultaneously apply second scan signals to the first scan line group and the second scan line group with the same timing as the first scan driving unit.

18. The OLED display of claim 13, wherein the timing controller is configured to generate: i) first and second scan control signals which respectively control the first and second scan drivers, ii) first and second data control signals which respectively control the first and second data drivers, and iii) a power control signal which controls the power supply, wherein the timing controller is further configured to generate each of the control signals based on an input control signal received from an external source, and wherein the timing controller is further configured to: i) generate first and second data signals based on an input image signal received from the external source and ii) respectively apply the first and second data signals to the first and second data drivers.

19. The OLED display of claim 13, wherein each of the pixels arranged in the first portion comprises:

a switching transistor comprising: i) a first terminal connect to a data line of the first data line group, ii) a gate terminal connected to a scan line of the first scan line group and iii) a second terminal connected to a first node;

a storage capacitor connected between a high power supply voltage and the first node;

a driving transistor comprising: i) a first terminal connected to the high power supply voltage, ii) a gate terminal connected to the first node and iii) a second terminal; and an OLED connected between the second terminal of the driving transistor and a low power supply voltage.

20. A method of driving an organic light-emitting diode (OLED) display, the method comprising:

first and second scan drivers substantially simultaneously scanning a plurality of pixels via a first scan line group and a second scan line group, wherein the first scan line group is arranged in a first portion of a display panel of the OLED display, wherein the second scan line group is arranged a second portion of the display panel, the second scan driver respectively applying scan signals to the same scan lines as the first scan driver but in opposite directions to prevent a voltage level of the respective scan signals from dropping, and wherein the first scan driver is arranged closer to the first portion than to the second portion and wherein the second scan driver is arranged closer to the second portion than to the first portion;

a first data driver outputting first data voltages to the pixels in the first portion via a first data line group; and a second data driver outputting second data voltages to the pixels in the second portion via a second data line group with the same driving timing as the first data driver.

21. A display panel module, comprising:

a display panel divided into a first portion comprising a plurality of first pixels and a second portion comprising a plurality of second pixels;

a plurality of scan lines divided into a first scan line group connected to the first pixels and a second scan line group connected to the second pixels, wherein the first scan line group is arranged in the first portion and the second scan line group is arranged in the second portion;

a first scan driver configured to sequentially scan the first and second scan line groups, wherein the first scan driver is further configured to sequentially scan the first scan line group at the same time the first scan driver sequentially scans the second scan line group a second scan driver configured to scan the first and second scan line groups with the same timing as the first driver, wherein the second scan driver respectively applies scan signals to the same scan lines as the first scan driver but in opposite directions to prevent a voltage level of the respective scan signals from dropping; and a plurality of data lines, wherein the first scan driver comprises at least a first scan integrated circuit (IC) and a second scan IC configured to apply first scan signals to the first scan line group and the second scan line group and wherein the second scan driver comprises at least a third scan IC and a fourth scan IC configured to apply second scan signals to the first scan line group and the second scan line group with the same timing as the first scan driver.

22. The display panel module of claim 21, wherein, the plurality of data lines is divided into a first data line group arranged in the first portion and connected to the first pixels and a second data line group arranged in the second portion and connected to the second pixels, and the display panel module further comprises:

a first data driver configured to output first data voltages to the first data line group, wherein the first data driver is not connected to the second data line group; and a second data driver configured to output second data voltages to the second data line group with the same timing as the first data driver, wherein the second data driver is not connected to the first data line group, wherein the first data line group is arranged in the first portion and not the second portion and the second data line group is arranged in the second portion and not the first portion.

23. The display panel module of claim 21, the first scan driver is further configured to substantially simultaneously apply the scan signals to corresponding scan lines of the first and second scan line groups.

* * * * *